US007217054B2

(12) United States Patent
Noguchi

(10) Patent No.: US 7,217,054 B2
(45) Date of Patent: May 15, 2007

(54) SIDE KNOCK TYPE FEEDING MECHANISM

(75) Inventor: Yoshio Noguchi, Kawagoe (JP)

(73) Assignee: Kotobuki Printing Co., Ltd., Kyoto-Shi, Kyoto-Fu (JP)

( * ) Notice: Subject to any disclaimer, the term of this patent is extended or adjusted under 35 U.S.C. 154(b) by 356 days.

(21) Appl. No.: 10/896,019

(22) Filed: Jul. 22, 2004

(65) Prior Publication Data

US 2005/0169695 A1 Aug. 4, 2005

(30) Foreign Application Priority Data

Feb. 2, 2004 (JP) ..... 2004-025112

(51) Int. Cl.
*A46B 11/04* (2006.01)
*B43K 5/06* (2006.01)

(52) U.S. Cl. ..... 401/277; 401/286; 401/171; 401/172; 401/174

(58) Field of Classification Search ..... 401/68, 401/75, 76, 92–94, 171–175, 277, 270, 278, 401/279, 286
See application file for complete search history.

(56) References Cited

U.S. PATENT DOCUMENTS 3,146,758 A 9/1964 Zepell
5,372,444 A * 12/1994 Lhuisset ..... 401/175
5,839,622 A * 11/1998 Bicknell et al. ..... 222/390
5,967,684 A 10/1999 Huang et al.
6,224,282 B1 * 5/2001 Ueki ..... 401/109
6,758,617 B2 * 7/2004 Sakaoka ..... 401/92

FOREIGN PATENT DOCUMENTS

| | | |
|---|---|---|
| DE | 199 21 662.2 | 11/2000 |
| EP | 0 787 445 A1 | 8/1997 |
| FR | 2 770 107 | 4/1999 |
| JP | 6-14844 | 4/1994 |
| JP | 2001-232273 | 8/2001 |
| WO | WO 00/25627 | 5/2000 |

* cited by examiner

*Primary Examiner*—David J. Walczak
(74) *Attorney, Agent, or Firm*—McGinn IP Law Group, PLLC

(57) ABSTRACT

A side knock type feeding mechanism for feeding an object to be fed inside a body by side knock. A front barrel which houses an object to be fed and is capable of feeding the object to be fed from a tip end opening, a knock button provided on a side portion of the front barrel so as to project and retract with respect to the front barrel, a rotary member which is inside the front barrel, rotates in a predetermined direction by knock of the knock button as a result that the knock button works, and rotates in an opposite direction by releasing the knock, a piston for feeding out the object to be fed, and a conversion mechanism for converting the rotation of the rotary member into a forward travelling motion of the piston in an axial direction inside the front barrel.

14 Claims, 9 Drawing Sheets

SIDE KNOCK TYPE FEEDING MECHANISM

BACKGROUND OF THE INVENTION

1. Field of the Invention

The present invention relates to a side knock type feeding mechanism for feeding an object to be fed such as a liquid or solid medium for cosmetics, writing or correction by side knock.

2. Description of the Related Art

Conventionally, as a container for feeding a liquid as an object to be fed, there is the one described in, for example, Japanese Utility Model Publication No. 6-14844. The liquid container described in the above Official Gazette is comprised of a barrel body in which a coating liquid storing portion is formed, a threaded bar projectingly provided at a piston slidably fitted into the storing portion, and a rotary cylinder integrally connecting an inner cylinder member and an outer cylinder member. The outer cylinder member has a ring protruded rib and an engaging claw, which is capable of being resilient in an axial direction in a tip end portion of the outer cylinder member of the rotary cylinder, so that the ring protruded rib is press-fitted into a ring groove at the rear end of the barrel body to rotatably connect the rotary cylinder to the barrel body, and the engaging claw of the outer cylinder member is elastically meshed with a ratchet tooth integrally formed in a circumferential direction in the barrel body to construct a ratchet mechanism. A threaded hole is provided in the inner cylinder member of the rotary cylinder to be screwed onto the threaded bar, two plane portions formed on both sides over the entire length of the threaded bar are slidably fitted into a slide hole formed in a partition wall of the rear end of the storing portion of the barrel body, and the threaded bar is advanced without being rotated by the rotation of the rotary cylinder to press the piston in the axial direction to supply a coating liquid.

When the rotary cylinder is rotated with respect to the barrel body, relative rotation occurs between the inner cylinder member of the rotary cylinder and the threaded bar because the threaded bar is slidably fitted in the slide hole formed in the partition wall of the rear end portion of the storing portion of the barrel body, and the threaded bar advances by thread engagement between the threaded bar and the threaded hole of the rotary cylinder to press the piston in the axial direction to make it possible to supply the coating liquid to a tip end of the barrel body.

However, the manipulation to rotate such rotary cylinder requires two hands wherein one hand holds the barrel body at the time of manipulation and the other hand rotates the rotary cylinder, thus causing the problem of inconvenience of the manipulation.

On the other hand, Japanese Patent Laid-Open No. 2001-232273 provides a knock type liquid container capable of supplying a liquid forward by a knock manipulation in order to solve the above problem. Its construction includes a tank housing a liquid and having a supply port on a tip end side, a piston sliding inside the tank, a threaded shaft connected integrally with the piston, extending rearward and having a male thread being formed on its peripheral surface to be unrotatable with respect to the tank, a rotary cam in which a female threaded hole to be screwed onto the male thread of the threaded shaft is formed, a knock cam disposed behind the rotary cam and rotating the rotary cam in one direction, and a knock body resilient rearward with respect to the knock cam and capable of knock manipulation. A protrusion is formed on either one of the knock body and the knock cam, and an inclined path which is inclined relative to the axial direction and in which the protrusion is fitted is formed at the other one, so that the knock cam rotates by the knock operation of the knock body to rotate the rotary cam.

However, even with such knock manipulation, in order to knock the knock body, it is necessary to change the way of holding by hand, and therefore there arises the problem of unfavorable manipulability.

SUMMARY OF THE INVENTION

The present invention is made in view of the above problems, and an object of the present invention is to provide a side knock type feeding mechanism capable of feeding an object to be fed and enhanced in manipulability at the time of feeding.

In order to achieve the object, the side knock type feeding mechanism according to the present invention comprises a body for housing an object to be fed and capable of feeding the object to be fed from a tip end opening thereof, a knock button provided in a side portion of the body so as to project and retract with respect to the body, a rotary member which is inside the body, rotates in a predetermined direction by knock of the knock button as a result that the knock button works, and rotates in an opposite direction by releasing the knock, a feeding body for feeding out the object to be fed, and a conversion mechanism for converting the rotation of the rotary member into a forward traveling motion of the feeding body in an axial direction inside the body.

When the knock button provided in the side portion of the body is knocked, the rotary member is rotated in the predetermined direction by the knock of the knock button, and the rotary member is rotated in the opposite direction by releasing the knock of the knock button. Since the conversion mechanism converts the rotation into the linear motion of the feeding body by utilizing any rotation of the reciprocating rotations in these rotating directions, the feeding body moves forward in the axial direction inside the body to move the object to be fed forward and feed the object to be fed out of the tip end opening of the body. In this manner, the object to be fed can be fed out by the side knock type manipulation, and therefore manipulability is enhanced.

The conversion mechanism can include a transmitting member capable of connecting to and disconnecting from the rotary member, and is connected to the rotary member to rotate in the same direction with respect to rotation of the rotary member in one direction, while disconnected from the rotary member with respect to rotation in a direction opposite to the one direction so that the rotation is not transmitted to the transmitting member. The rotary member reciprocatingly rotates by knock or release of knock of the knock button, but the transmitting member transmits only the rotation of the rotary member in one direction, and therefore by utilizing any rotation of the reciprocating rotations of the rotary member, the rotation can be used for feeding of the object to be fed.

Furthermore, the conversion mechanism can include a ratchet mechanism which transmits the rotation in the one direction from the rotary member to the transmitting member, and does not transmit the rotation in the direction opposite to the one direction from the rotary member. The rotation of the transmitting member can be limited to only one direction by the ratchet mechanism irrespective of the reciprocating rotations of the rotary member.

Furthermore, the conversion mechanism can include a second ratchet mechanism which allows the rotation in the one direction of the transmitting member and inhibits the rotation in the direction opposite to the one direction. The rotation of the transmitting member can be limited to only one direction and unnecessary rotation of the transmitting member can be prevented, by the second ratchet mechanism.

The conversion mechanism can include a screw mechanism for advancing a feeding body with respect to the rotation in the one direction transmitted from the rotary member. The rotation in the one direction from the rotary member can be converted into the linear motion of the feeding body.

The side knock type feeding mechanism can further comprise a rotation control mechanism for controlling the rotating directions of the rotary member. The rotating directions of the rotary member can be reliably controlled by this rotation control mechanism.

The rotation control mechanism can include a knock receiving protrusion which is provided on a side portion of the rotary member, and on which the knock button is capable of working at a time of knock, an engaging member which is engaged with the rotary member, moves in one direction in an axial direction by rotation of the rotary member in the predetermined direction, and moves in an opposite direction in the axial direction by rotation of the rotary member in the opposite direction, and a biasing member for biasing the engaging member in a direction to move in the opposite direction. When the knock button is knocked, the knock button works on the protrusion of the rotary member and rotates the rotary member in the predetermined direction. At this time, the engaging member moves in one direction in the axial direction against the biasing force by the biasing member. On the other hand, when the knock of the knock button is released, the engaging member returns in the opposite direction in the axial direction into the original state by the biasing force by the biasing member, and therefore the rotary member also returns into the original state and can rotate in the opposite direction.

The rotation control mechanism can include a cam mechanism which moves the engaging member in one direction in the axial direction by rotation of the rotary member in the predetermined direction and moves the engaging member in the opposite direction in the axial direction by the rotation of the rotary member in the opposite direction. The reciprocating rotating motion of the rotary member can be converted into the reciprocating motion of the engaging member in the axial direction by the cam mechanism.

According to the present invention, the object to be fed can be fed out by the side knock manipulation, and therefore manipulability can be enhanced.

The present disclosure relates to subject manner contained in Japanese Patent Application No. 2004-25112, filed on Feb. 2, 2004, which is expressly incorporated herein by reference in its entirety.

DETAILED DESCRIPTION OF THE PREFERRED EMBODIMENTS

Figure 1:
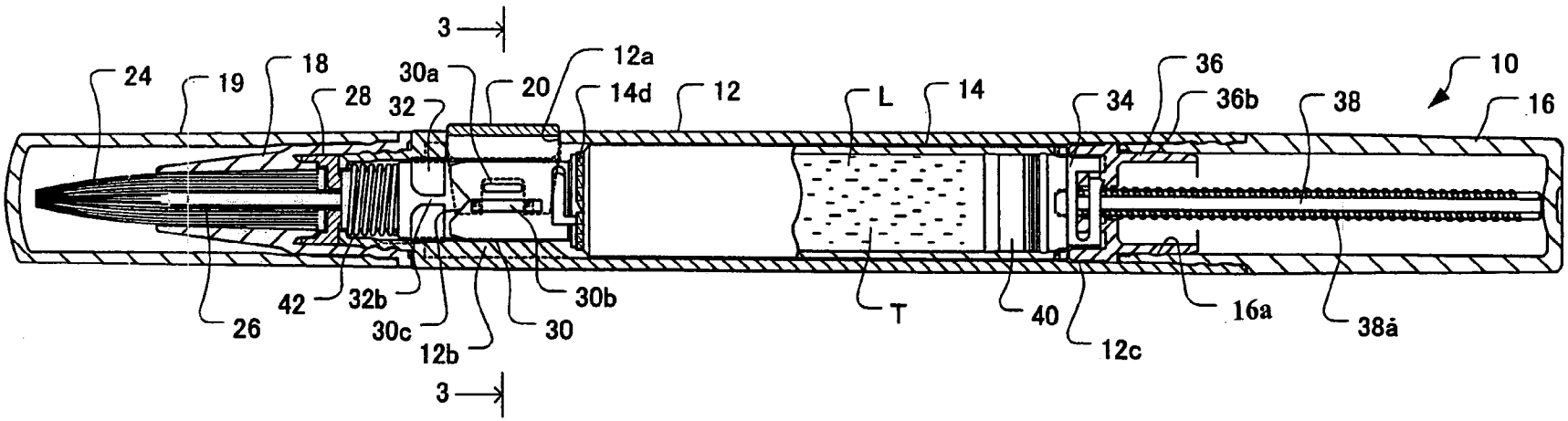
FIG. 1 is an overall longitudinal cross-sectional view showing an embodiment of a liquid container including a side knock type feeding mechanism of the present invention.
Figure 2:
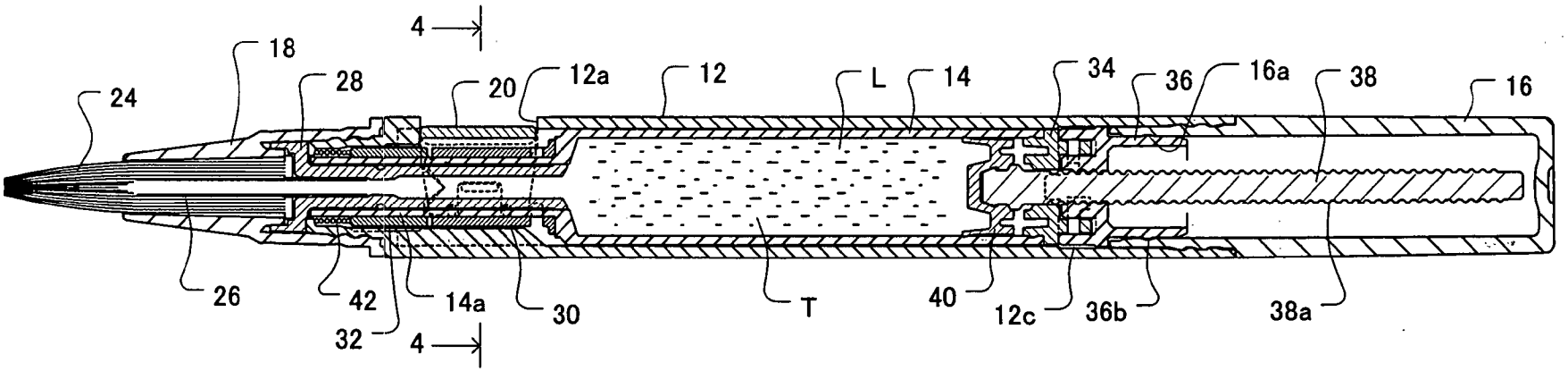
FIG. 2 is a longitudinal cross-sectional view showing a state in which a cap is removed and side knock manipulation is performed.

Hereinafter, an embodiment of the present invention will be explained referring to the drawings. FIG. 1 is an overall longitudinal cross-sectional view showing an embodiment of a liquid container including a side knock type feeding mechanism of the present invention, and FIG. 2 is a longitudinal cross-sectional view of a state in which a cap is removed and side knock manipulation is performed.

In the drawings, a liquid container 10 including a side knock type feeding mechanism mainly includes a front barrel 12 which an user grips, an inner barrel 14 provided inside the front barrel 12 concentrically with the front barrel 12 and rotatably with respect to the front barrel 12, a rear barrel 16 mounted to a rear end of the front barrel 12, a tip tool 18 mounted to the tip end of the front barrel 12, and a cap 19 detachably fitted on the tip tool 18. An inside of the inner cylinder 14 forms a tank portion T in which a liquid L for correction, writing, cosmetics, etc, is housed. The front barrel 12, the rear barrel 16 and the tip tool 18 construct a body.

An opening 12*a* is formed on a side surface of a tip end portion of the front barrel 12, a knock button 20 for the user to manipulate is provided in the opening 12*a*, and the knock button 20 is capable of projecting and retracting in an inward and outward direction of the front barrel 12.

A brush 24 that is a liquid supply body for coating the liquid, a tip end pipe 26 for transmitting the liquid to the brush 24, and a pipe holder 28 which is fixed inside the tip tool 18 and simultaneously fixes the brush 24 and the tip end pipe 26 to the tip tool 18 are provided inside the tip tool 18. A rear end of the pipe holder 28 is inserted into a reduced diameter portion 14*a* in the tip end portion of the inner cylinder 14.

Figure 5:
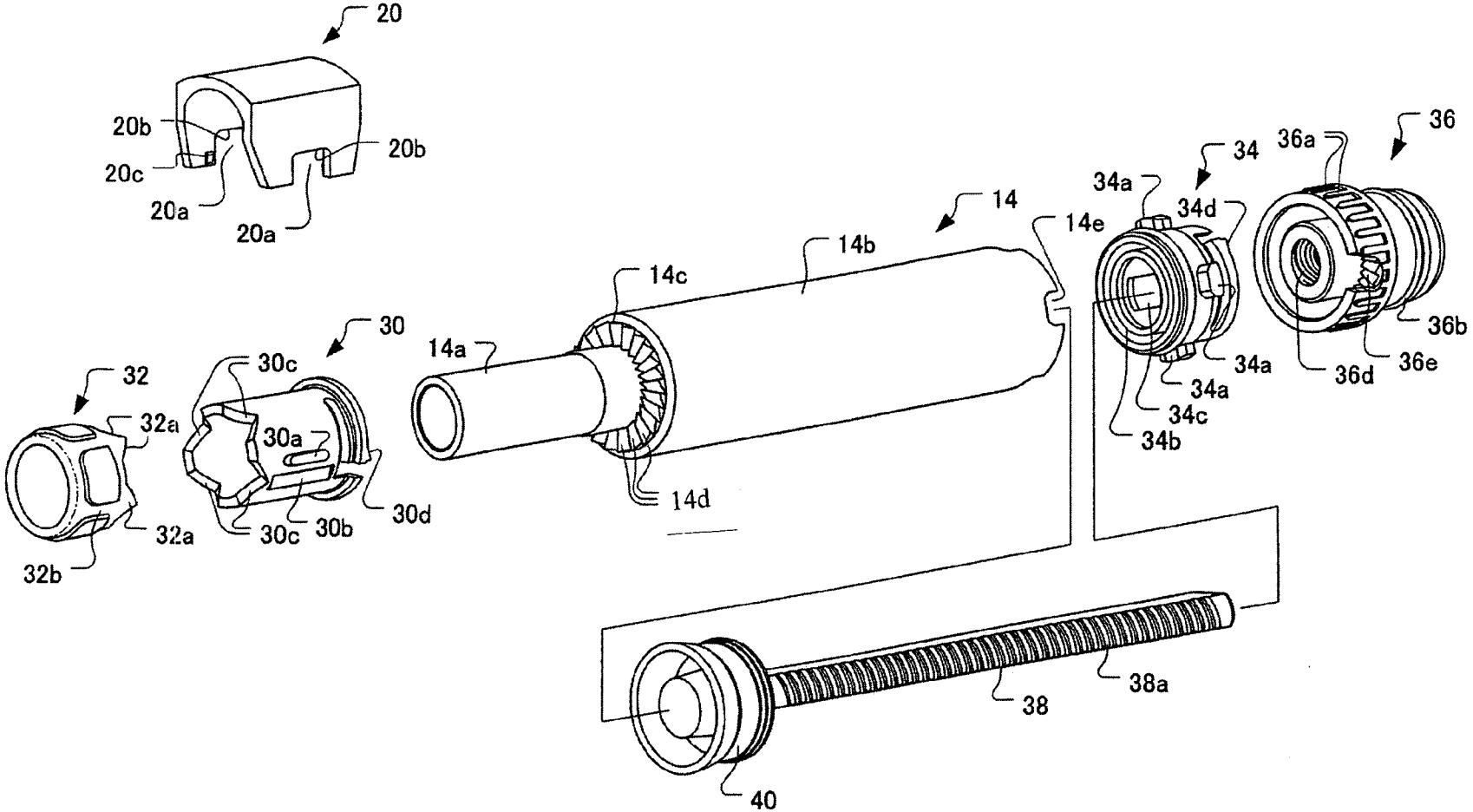
FIG. 5 is an exploded perspective view of major components of a side knock type feeding mechanism.
Figure 6E:
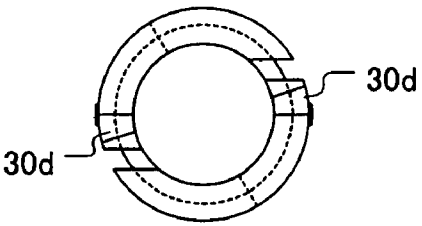
FIG. 6E is a view seen along the arrow e in FIG. 6A, of the rotary member.
Figure 6A:
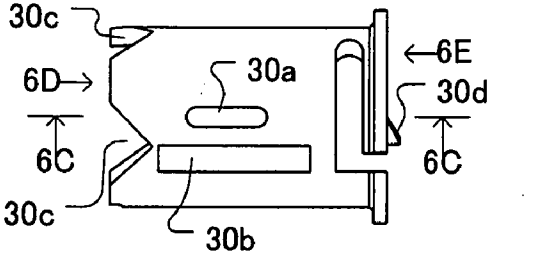
FIG. 6A is a side view.
Figure 6B:
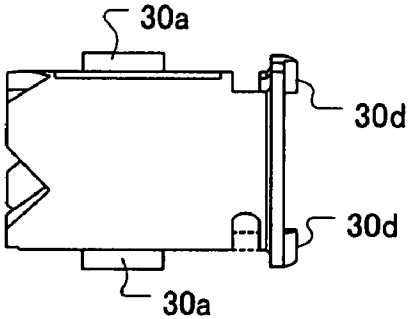
FIG. 6B is a plan view.
Figure 6C:
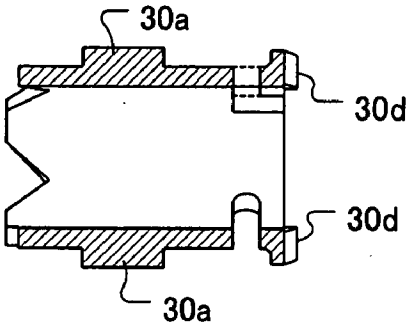
FIG. 6C is a cross-sectional view taken along the line c—c in FIG. 6A.
Figure 6D:
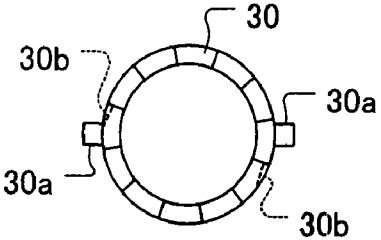
FIG. 6D is a view seen along the arrow d in FIG. 6A.

The feeding mechanism of the liquid container 10 for feeding the liquid in the tank portion T to the brush 24 has, as shown in FIG. 5, the knock button 20 capable of projecting from and retracting into the front barrel 12 constructing the body, a rotary member 30 on which the knock button 20 directly works, an engaging member 32 placed on a front side of the rotary member 30, the inner cylinder 14, a rotation stopping member 34 provided at a rear end of the inner cylinder 14, an inside screw member 36 fixed to the front barrel 12, a piston rod 38 screwed into the inside screw member 36, a piston 40 connected to a tip end of the piston rod 38 and slidable inside the tank portion T, and a return spring 42 as a biasing member for giving an urging force to the engaging member 32.

The inner cylinder 14 and the rotation stopping member 34 construct a transmitting member to which the rotation from the rotary member 30 is transmitted, and the piston rod 38 and the piston 40 construct a feeding body for feeding the liquid inside the tank portion T. The inner cylinder 14, the rotation stopping member 34, the inside screw member 36 and the piston rod 38 construct a conversion mechanism for converting the rotation of the rotary member 30 into a forward traveling motion of the feeding body in the axial direction inside the body, and the engaging member 32 and the return spring 42 construct a rotation control mechanism for controlling a rotating direction of the rotary member 30. However, this example is one example, and it is possible to construct the transmission member, the conversion mechanism and the rotation control mechanism by optional members.

The respective members will be explained in detail hereinafter.

First, the knock button 20 is in an approximately reversed U shape in a cross section, and rectangular notched portions 20*a* are formed at lower ends of its both side surfaces, and upper surfaces of the rectangular notched portions 20*a* become working surfaces 20*b* working on the rotary member 30. Slipping off preventing ribs 20*c* are formed on an inner surface of the knock button 20, which are adjacent to the notched portions 20*a*.

As shown in FIGS. 6A to 6E, the rotary member 30 is formed in a cylindrical shape, and the reduced diameter portion 14*a* of the inner cylinder 14 penetrates through an inside of the rotary member 30. Projections 30*a* and 30*a* are formed on the side surfaces of the rotary member 30 so that the working surfaces 20*b* of the knock button 20 can press the projection 30*a*. Two projections 30*a* are formed to keep balance, but only one of the projections 30*a* always serves as a knock receiving projection for actually receiving the knock force of the knock button 20.

The slipping off preventing recessed portions 30*b* and 30*b* are formed in close vicinity of the projections 30*a* and 30*a*. The slipping off preventing recessed portion 30*b* engages with the slipping off preventing rib 20*c* when the knock button 20 is not knocked. As for engagement of the slipping off preventing recessed portion 30*b* and the slipping off preventing rib 20*c*, their sectional shapes are set so that the slipping off preventing rib 20*c* is prevented from moving in the direction approaching the opening 12*a* but is allowed to move in the opposite direction approaching the opening 12*a* by the slipping off preventing recessed portion 30*b* (see FIG. 3 and FIG. 4).

A plurality of cam inclined surfaces 30*c* are formed at the tip end of the rotary member 30, and the cam inclined surfaces 30*c* are inclined with respect to the axial direction. A plurality of ratchet teeth 30*d* elastically deformable in the axial direction are formed at the rear end of the rotary member 30.

Figure 7A:
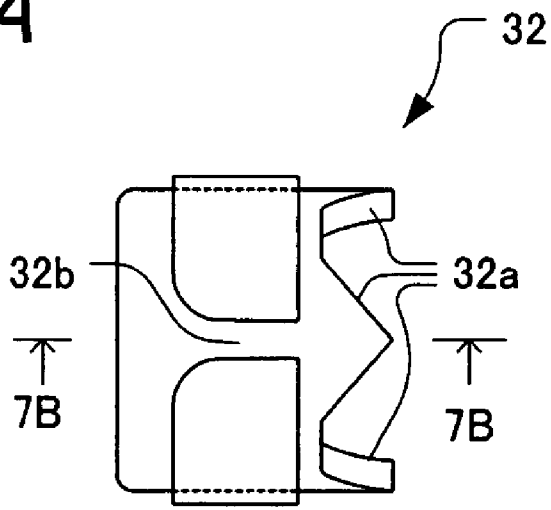
FIG. 7A is a plan view.
Figure 7B:
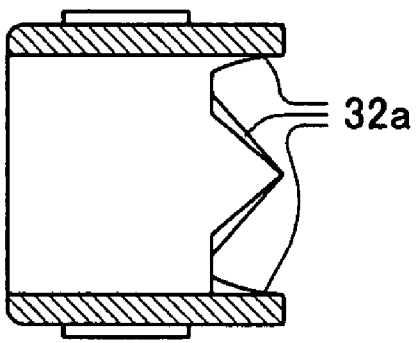
FIG. 7B is a sectional view taken along the line b—b in FIG. 7A, of an engaging member.

As shown in FIGS. 7A and 7B, an engaging member 32 disposed in front of the rotary member 30 is formed into a cylindrical shape, and the reduced diameter portion 14*a* of the inner cylinder 14 penetrates through the inside of the engaging member 32. Cam inclined surfaces 32*a* which can engage and slide in contact with a plurality of cam inclined surfaces 30*c* of the rotary member 30 are formed at the rear end of the engaging member 32. The cam inclined surfaces 32*a* are inclined with respect to the axial direction. A plurality of rotation stopping grooves 32*b* extending in the axial direction are formed on the peripheral surface of the engaging member 32, and a rotation stopping rib 12*b* formed on the inner peripheral surface of the front barrel 12 is fitted in the rotation stopping groove 32*b*, whereby the engaging member 32 can move in the axial direction with respect to the front barrel 12 but cannot rotate with respect to the front barrel 12.

Figure 8A:
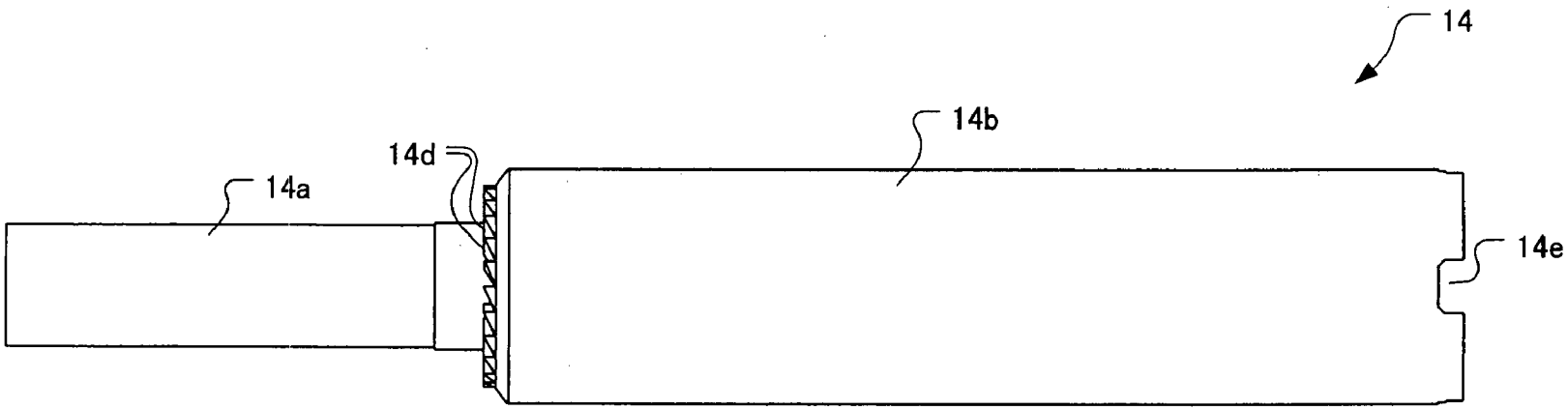
FIG. 8A is a plan view and FIG. 8B is a longitudinal cross-sectional view, of an inner cylinder.
Figure 8B:
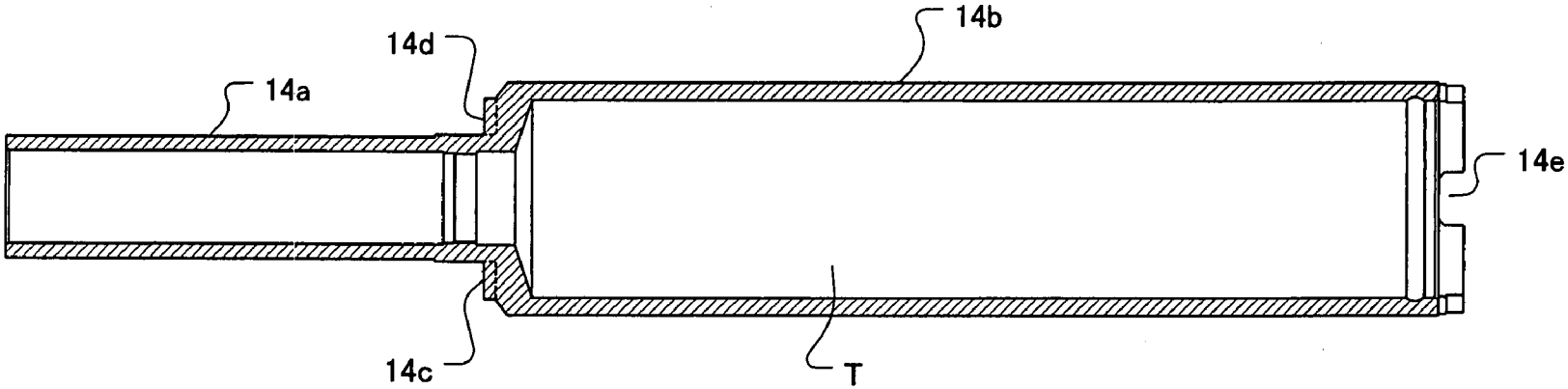

As shown in FIGS. 8A and 8B, the inner cylinder 14 which defines the tank portion T and constructs the transmitting member has the reduced diameter portion 14*a* in the front end portion and an enlarged diameter portion 14*b* in the rear end portion. Sawteeth 14*d* are formed continuously in the circumferential direction on a boundary step portion 14*c* between the reduced diameter portion 14*a* and the enlarged diameter portion 14*b*. The saw teeth 14*d* can be meshed with the ratchet teeth 30*d* of the rotary member 30. The saw teeth 14*d* and the ratchet teeth 30*d* construct a first ratchet mechanism. A plurality of fitting notches 14*e* are formed at the rear end portion of the inner cylinder 14.

Figure 9B:
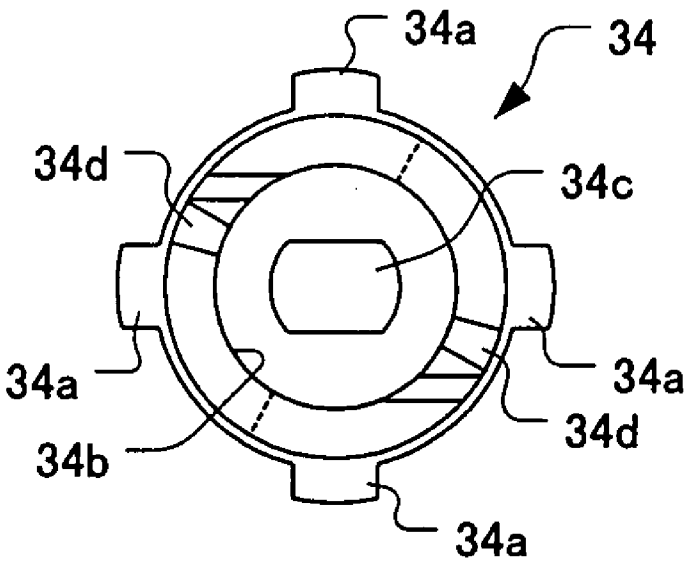
FIG. 9A is a side view of a rotation stopping member and FIG. 9B is a view seen along the arrow b in FIG. 9A.
Figure 9A:
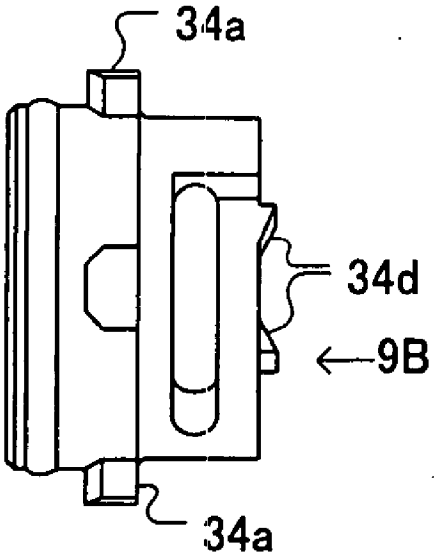

The rotation stopping member 34 provided at the rear end of the inner cylinder 14 forms a cylindrical shape. As shown in FIGS. 9A and 9B, a plurality of fitting protrusions 34*a* which fit into the fitting notches 14*e* of the inner cylinder 14 are formed on the outer peripheral surface of the rotation stopping member 34. The fitting protrusions 34*a* fit into the fitting notches 14*e*, whereby the inner cylinder 14 and the rotation stopping member 34 are integrally connected. It is possible to construct the inner cylinder 14 and the rotation stopping member 34 as an integrated component, but it is desirable to construct them as separate components in molding.

An inner cylinder portion 34*b* is formed inside the rotation stopping member 34, a non-circular hole 34*c* through which the piston rod 38 penetrates is formed in a center of the inner cylinder portion 34*b*. The cross-sectional shape of the piston rod 38 is formed into anon-circular shape, and the non-circular hole 34*c* corresponds to the cross-sectional shape of the piston rod 38, whereby the piston rod 38 is unrotatable with respect to the rotation stopping member 34.

A plurality of ratchet teeth 34*d* elastically deformable in the axial direction are formed at the rear end of the rotation stopping member 34.

Figure 10A:
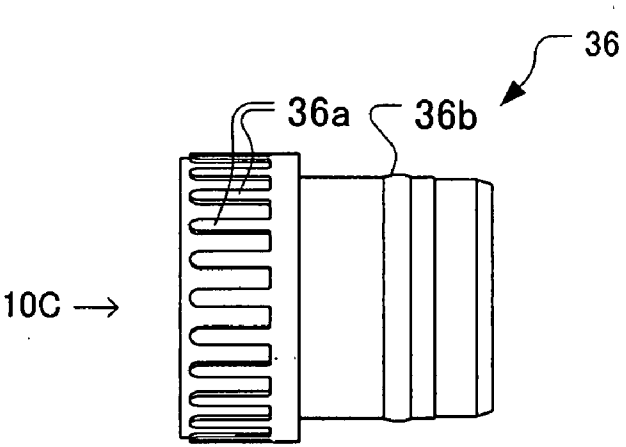
FIG. 10A is a plan view.
Figure 10B:
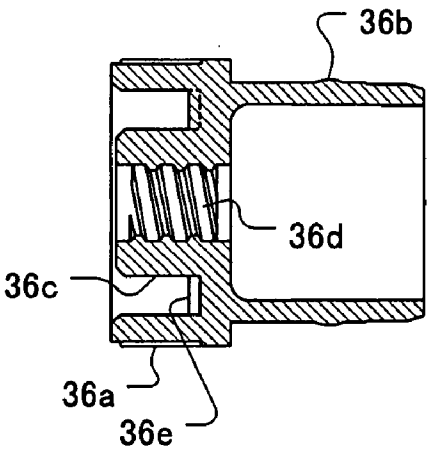
FIG. 10B is a longitudinal cross-sectional view of an inside screw member and FIG. 10C is a view seen along the arrow c in FIG. 10A.
Figure 10C:
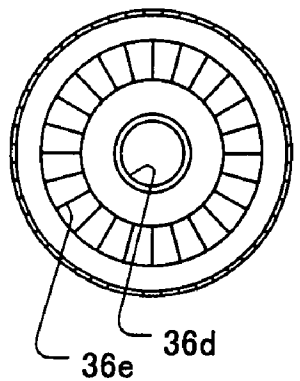

As shown in FIGS. 10A to 10C, the inside screw member 36 disposed behind the rotation stopping member 34 is formed into a cylindrical shape, and a number of rotation stopping ribs 36*a* extending in the axial direction are formed on an outer peripheral surface of the inside screw member 36. The rotation stopping rib 36*a* is fitted in the rotation stopping groove 12*c* formed on the front barrel 12, and thereby the inside screw member 36 is prevented from rotating with respect to the front barrel 12. Further, an annular fitting rib 36*b* is formed on the outer peripheral surface of the rear end portion of the inside screw member 36. The fitting rib 36*b* is fitted into an annular fitting groove 16*a* formed in the rear barrel 16, and the inside screw member 36 is fixed to the body.

An inner cylinder portion 36*c* is formed inside the inside screw member 36, and a female threaded hole 36*d* is formed in a center of the inner cylinder portion 36*c*. A male thread 38*a* formed on an outer peripheral surface of the piston rod 38 is screwed into the female thread hole 36*d*. The screw mechanism is constructed by the male thread 38*a* of this piston rod 38 and the female threaded hold 36*d* of the inside screw member 36.

Furthermore, sawteeth 36*e* are formed continuously in the circumferential direction on a surface extending in the circumferential direction between the outer cylinder portion and the inner cylinder portion 36*c* of the inside screw member 36, with facing to the front. A rear end portion of the rotation stopping member 34 is inserted between the outer cylinder portion and the inner cylinder portion 36*c* of the inside screw member 36, and the sawteeth 36*e* can mesh with the ratchet teeth 34*d* of the rotation stopping member 34. A second ratchet mechanism is constructed by the sawteeth 36*e* and the ratchet teeth 34*d*.

Figure 3:
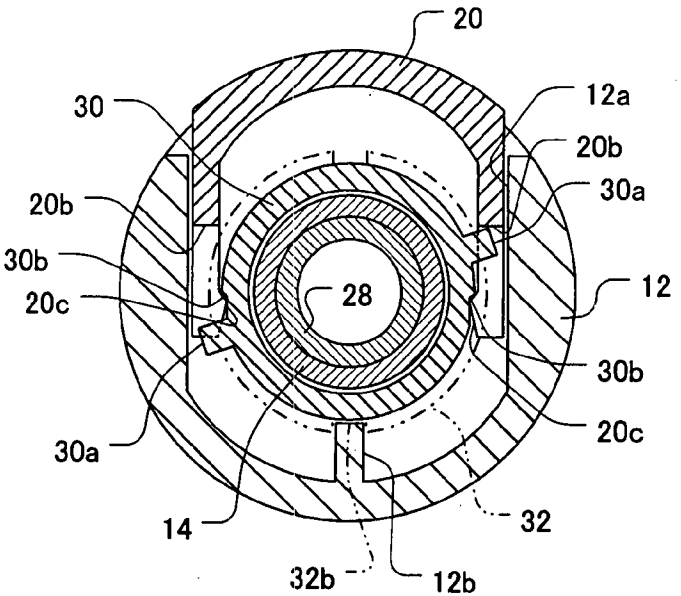
FIG. 3 is a cross-sectional view taken along the line 3—3 in FIG. 1.

As shown in FIG. 3, in the normal state in which the knock button 20 is not knocked, the cam inclined surface 30*c* of the rotary member 30 is engaged with the cam inclined surface 32*a* of the engaging member 32 so that the protrusions 30*a* and 30*a* are not horizontal but hold the inclined state. The engaging member 32 is biased toward the rotary member 30 by the return spring 42, and therefore the engagement of the cam inclined surface 30*c* and the cam inclined surface 32*a* is held. The knock receiving protrusion 30*a* which is one of the protrusions 30*a* is positioned in close vicinity to the working surface 20*b* of the knock button 20.

An operation of the liquid container 10 including the feeding mechanism constructed as above will be explained. First, when the liquid container 10 is used, the cap 19 is removed, and the liquid L is supplied by using the brush 24. The liquid L from the tank portion T is supplied to the brush 24 via the pipe holder 28 and the tip end pipe 26.

When the liquid L is fed from the tank portion T, the knock button 20 is pressed and pushed into the front barrel 12. The working surface 20*b* of the knock button 20 presses the knock receiving protrusion 30*a* of the rotary member 30 downward in FIG. 3, and therefore the rotary member 30 is rotated in the clockwise direction in FIG. 3. When the rotary member 30 is rotated, the ratchet teeth 30*d* of the rotary member 30 are meshed with the sawteeth 14*d* of the inner cylinder 14, and this first ratchet mechanism transmits the clockwise rotation of the rotary member 30 to the inner cylinder 14. Therefore, the inner cylinder 14 rotates in the same direction and the rotation stopping member 34 is rotated together. Since the ratchet teeth 34*d* of the rotation stopping member 34 can slide on the sawteeth 36*e* of the inside screw member 36, and this second ratchet mechanism allows the rotation of the rotation stopping member 34, relative rotation movement occurs between the rotation stopping member 34 and the inside screw member 36. Since the piston rod 38 is unrotatable with respect to the rotation stopping member 34, the piston rod 38 rotates together with the rotation stopping member 34, and since the piston rod 38 is screwed into the female threaded hole 36*d* of the inside screw member 36, the piston rod 38 moves in the axial direction. Thus, the piston 40 connected to the piston rod 38 is pressed forward, and therefore the piston 40 slides within the tank portion T and can feed the liquid L inside the tank portion T forward.

Figure 4:
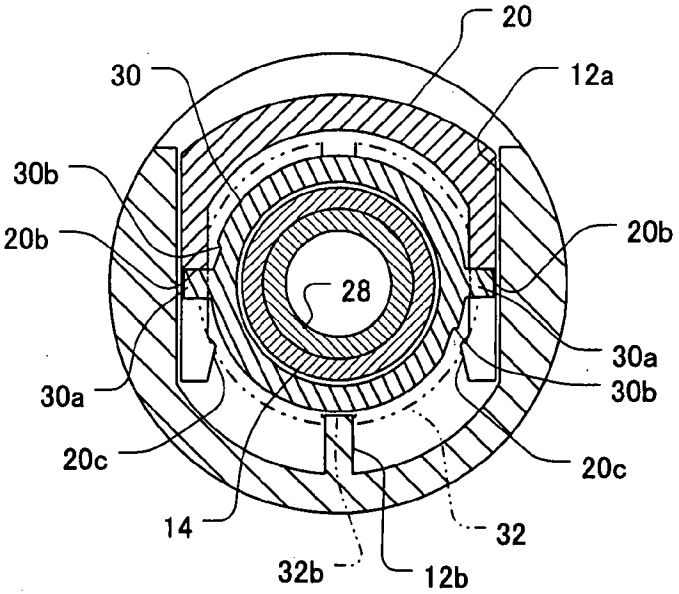
FIG. 4 is a cross-sectional view taken along the line 4—4 in FIG. 2.

Since the rotary member 30 rotates from the state shown in FIG. 3 to the state shown in FIG. 4 per one knock of the knock button 20, and the piston rod 38 in synchronism with this also rotates by the same angle, the piston 40 moves in the axial direction by (angle of rotation/360)×pitch.

When this rotary member 30 rotates into the state shown in FIG. 4, the engaging member 32 cannot be rotated. Therefore the cam inclined surfaces 32*a* of the engaging member 32 are in sliding contact with the cam inclined surfaces 30*c* of the rotary member 30, and the engaging member 32 moves forward against the biasing force of the return spring 42.

When the knocking force to the knock button 20 is released, the engaging member 32 is returned rearward by the restoring force of the return spring 42, the cam inclined surfaces 30*c* of the rotary member 30 slide in contact with the cam surfaces 32*a* of the engaging member 32, rotate in the counterclockwise direction in FIG. 4, and returns to the original position shown in FIG. 3.

At this time, since the ratchet teeth 34*d* of the rotation stopping member 34 are meshed with the sawteeth 36*e* of the inside screw member 36, and this second ratchet mechanism inhibits the counterclockwise rotation of the inner cylinder 14 and the rotation stopping member 34, the inner cylinder 14 and the rotation stopping member 34 cannot rotated with the rotary member 30. As a result, the ratchet teeth 30*d* of the rotary member 30 slides on the sawteeth 14*d* of the inner cylinder 14, only the rotary member 30 rotates and returns into the original state, and thereby the knock button 20 returns to the upper position shown in FIG. 3.

Since in the state in which the knock button 20 is not knocked, the engaging member 32 is biased rearward by the return spring 42, and the rotary member 30 is fixed in the posture shown in FIG. 3, the rotary member 30 does not rotate unexpectedly.

In this manner, every time the knock button 20 is knocked, the piston 40 and the piston rod 38 move forward, and the liquid L which is the object to be fed can be fed from the brush 24 placed at the tip end of the body. Since the liquid L can be fed by the side knock onto the knock button 20, it is not necessary to change the grasp of the front barrel 12, it is not necessary to use both hands, and the manipulation can be simplified.

In the above example, the explanation is made with the example in which the feeding mechanism is included in the liquid container for pushing out the liquid, but the present invention is not limited to this, and the object to be fed may be solid.

It is possible to construct the component constructed by a plurality of members in the above embodiment by a single member, or it is possible to construct the component constructed by a single member by a plurality of members.

While the principles of the invention have been described above in connection with specific embodiments, and particular modifications thereof, it is to be clearly understood that this description is made only by way of example and not as a limitation on the scope of invention.

What is claimed is:

1. A side knock type feeding mechanism comprising, a body for housing an object to be fed and capable of feeding the object to be fed from a tip end opening thereof;

a knock button provided on a side portion of the body so as to project and retract with respect to the body;

a rotary member which is inside the body, rotates in a predetermined direction by knock of the knock button as a result that the knock button works, and rotates in an opposite direction by releasing the knock;

a feeding body for feeding out the object to be fed; and a conversion mechanism for converting the rotation of the rotary member into a forward traveling motion of said feeding body in an axial direction inside the body, wherein said conversion mechanism includes a transmitting member capable of connecting to and disconnecting from the rotary member, said transmitting member being connected to the rotary member to rotate in the same direction with respect to rotation of the rotary member in one direction, whereas disconnected from the rotary member with respect to rotation in a direction opposite to the one direction so that the rotation is not transmitted to the transmitting member.

2. The side knock type feeding mechanism according to claim 1, wherein said conversion mechanism includes a ratchet mechanism which transmits the rotation in said one direction from said rotary member to the transmitting member, and does not transmit the rotation in the direction opposite to the one direction from said rotary member.

3. The side knock type feeding mechanism according to claim 2, wherein said conversion mechanism includes a second ratchet mechanism which allows the rotation in said one direction of said transmitting member and inhibits the rotation in the direction opposite to the one direction of said transmitting member.

4. The side knock type feeding mechanism according to claim 2, wherein said conversion mechanism includes a screw mechanism for advancing said feeding body with respect to the rotation in a direction transmitted from the rotary member.

5. The side knock type feeding mechanism according to claim 1, wherein said conversion mechanism includes a second ratchet mechanism which allows the rotation in said one direction of said transmitting member and inhibits the rotation in the direction opposite to the one direction.

6. The side knock type feeding mechanism according to claim 5, wherein said conversion mechanism includes a screw mechanism for advancing said feeding body with respect to the rotation in a direction transmitted from the rotary member.

7. The side knock type feeding mechanism according to claim 1, further comprising a rotation control mechanism for controlling the rotating directions of the rotary member.

8. The side knock type feeding mechanism according to claim 7, wherein said rotation control mechanism includes a knock receiving projection provided on a side portion of the rotary member, and on which the knock button is capable of working at a time of knock, an engaging member which is engaged with the rotary member, moves in one direction in an axial direction by rotation of the rotary member in the predetermined direction, and moves in an opposite direction in the axial direction by rotation of the rotary member in said opposite direction, and a biasing member for biasing the engaging member in a direction to move in the opposite direction in the axial direction.

9. The side knock type feeding mechanism according to claim 8, wherein said rotation control mechanism includes a cam mechanism which moves the engaging member in one direction in the axial direction by rotation of the rotary member in the predetermined direction, and which moves the engaging member in the opposite direction in the axial direction by rotation of the rotary member in the opposite direction.

10. The side knock type feeding mechanism according to claim 1, wherein said conversion mechanism includes a screw mechanism for advancing a said feeding body with respect to the rotation in a direction transmitted from the rotary member.

11. A side knock type feeding mechanism comprising, a body for housing an object to be fed and capable of feeding the object to be fed from a tip end opening thereof;

a knock button provided on a side portion of the body so as to project and retract with respect to the body;

a rotary member which is inside the body, rotates in a predetermined direction by knock of the knock button as a result that the knock button works, and rotates in an opposite direction by releasing the knock;

a feeding body for feeding out the object to be fed; and a conversion mechanism for converting the rotation of the rotary member into a forward traveling motion of said feeding body in an axial direction inside the body, wherein said conversion mechanism includes a screw mechanism for advancing feeding body with respect to the rotation in a direction transmitted from the rotary member.

12. The side knock type feeding mechanism according to claim 11, further comprising a rotation control mechanism for controlling the rotating directions of the rotary member.

13. The side knock type feeding mechanism according to claim 12, wherein said rotation control mechanism includes a knock receiving projection provided on a side portion of the rotary member, and on which the knock button is capable of working at a time of knock, an engaging member which is engaged with the rotary member, moves in one direction in an axial direction by rotation of the rotary member in the predetermined direction, and moves in an opposite direction in the axial direction by rotation of the rotary member in said opposite direction, and a biasing member for biasing the engaging member in a direction to move in the opposite direction in the axial direction.

14. The side knock type feeding mechanism according to claim 13, wherein said rotation control mechanism includes a cam mechanism which moves the engaging member in one direction in the axial direction by rotation of the rotary member in the predetermined direction, and which moves the engaging member in the opposite direction in the axial direction by rotation of the rotary member in the opposite direction.

* * * * *